US008439725B2

(12) United States Patent
Bögl

(10) Patent No.: US 8,439,725 B2
(45) Date of Patent: May 14, 2013

(54) METHOD AND DEVICE FOR THE PRODUCTION OF A PRECISE CONCRETE PREFABRICATED PART

(75) Inventor: Stefan Bögl, Sengenthal (DE)

(73) Assignee: Max Bogl Bauunternehmung GmbH & Co. KG, Neumarkt (DE)

( * ) Notice: Subject to any disclaimer, the term of this patent is extended or adjusted under 35 U.S.C. 154(b) by 1593 days.

(21) Appl. No.: 10/517,711

(22) PCT Filed: Mar. 14, 2003

(86) PCT No.: PCT/EP03/02681

§ 371 (c)(1),
(2), (4) Date: Dec. 10, 2004

(87) PCT Pub. No.: WO03/106128

PCT Pub. Date: Dec. 24, 2003

(65) Prior Publication Data

US 2005/0241262 A1 Nov. 3, 2005

(30) Foreign Application Priority Data

Jun. 13, 2002 (DE) ..... 102 26 407

(51) Int. Cl.
*B24B 1/00* (2006.01)

(52) U.S. Cl.
USPC ..... 451/41; 451/57; 451/58; 451/177; 451/179; 451/259; 451/540; 451/541; 451/548

(58) Field of Classification Search ..... 451/41, 451/57, 58, 177, 179, 259, 540, 541, 548
See application file for complete search history.

(56) References Cited

U.S. PATENT DOCUMENTS

| | | | | |
|---|---|---|---|---|
| 4,280,657 | A * | 7/1981 | Ramer | 238/267 |
| 5,209,020 | A * | 5/1993 | Feisel | 451/11 |
| 5,954,568 | A | 9/1999 | Wirz | |
| 6,895,276 | B2 | 5/2005 | Kast et al. | |

FOREIGN PATENT DOCUMENTS

| | | |
|---|---|---|
| DE | 27328 | 11/1964 |
| DE | 1942538 | 9/1970 |
| DE | 29711133 U1 | 10/1997 |
| DE | 19846765 A1 | 5/1999 |
| DE | 19753705 A1 | 6/1999 |
| EP | 0735189 B1 | 10/1996 |
| EP | 0865870 B1 | 9/1998 |

(Continued)

OTHER PUBLICATIONS

German Patent Office Search Report, Dec. 2, 2002.

(Continued)

*Primary Examiner* — Lee D Wilson
*Assistant Examiner* — Shantese McDonald
(74) *Attorney, Agent, or Firm* — Dority & Manning, P.A.

(57) ABSTRACT

With a method for the production of a precise prefabricated concrete part, especially in the form of a sleeper or a plate for a fixed track for rail-guided vehicles, the prefabricated concrete part is ground at the functionally relevant points to the predetermined size by means of a grooved roller. The device for this is a grinding machine with a grooved roller to grind the prefabricated concrete part at functionally relevant points to a predetermined size. The grooved roller is made of a wear resistant material, especially silicon carbide.

2 Claims, 3 Drawing Sheets

FOREIGN PATENT DOCUMENTS

| | | | | |
|---|---|---|---|---|
| EP | 0932725 | B1 | | 8/1999 |
| GB | 981085 | | | 1/1965 |
| JP | 61-109695 | | | 5/1986 |
| JP | A-61-109695 | | * | 5/1986 |
| JP | 08/323736 | A | | 12/1996 |
| JP | 11-280001 | | | 10/1999 |
| JP | 11280001 | | * | 10/1999 |
| JP | 2001145917 | A | | 5/2001 |
| RU | 612804 | | | 6/1978 |
| RU | 963837 | | | 10/1982 |
| RU | 2038943 | | | 7/1995 |
| SU | 612804 | | | 6/1978 |
| SU | 963837 | | | 10/1982 |

OTHER PUBLICATIONS

PCT Search Report, Jul. 17, 2003.
International Preliminary Examination Report, Jan. 19, 2005.
CN 03813778.X, First Office Action, issued Dec. 8, 2006.
JP 512996/2004, Office Action Report, issued Mar. 17, 2009.
JP 512995/2004, Office Action Report, issued Feb. 23, 2010.
JP 512995/2004, Office Action Report, issued Mar. 22, 2011.
KR 7020307/2004, Office Action and Examination Result, issued Nov. 25, 2008.
KR 7020307/2004, Office Action and Examination Result, issued May 29, 2009.
KR 7020307/2004, Notice of Examination Result of Pretrial Reexamination, issued May 04, 2010.
KR 7020307/2004, Decision of Rejection and Reexamination Result, issued Nov. 25, 2009.
KR 7020307/2004, Appeal against Decision of Rejection, issued Apr. 21, 2011.
JP 512995/2004, Final Rejection, issued Sep. 20, 2011.
EP 03712020.10ffice Action, issued Jun. 13, 2006.
RU 2005100521/03(000547) Office Action, issued Jan. 30, 2007.
RU 2005100421/03(000547), Office Action, issued Apr. 18, 2007.

* cited by examiner

METHOD AND DEVICE FOR THE PRODUCTION OF A PRECISE CONCRETE PREFABRICATED PART

FIELD OF THE INVENTION

The present invention relates to a method for the production of a precise concrete prefabricated part, especially in the form of a sleeper or plate for a fixed track for rail-guided vehicles, as well as to a suitable device for the production of a precise concrete prefabricated part.

BACKGROUND

Fixed tracks for rail-guided vehicles, wall elements, girders or supports are produced e.g. in the form of prefabricated concrete parts. In most applications of prefabricated concrete parts, no special precision is required with respect to the part's dimensions. The usual tolerances that can be attained in the concrete trade are here sufficient. If other components that must respect especially narrow tolerances are mounted on the prefabricated concrete parts, this is normally done with installation devices so that the lack of precision originating in the concrete can be compensated for. Especially in the production of fixed tracks, such as are known e.g. from DE 197 33 9909 A1, rail fasteners are therefore used at different supporting points that render the rail adjustable in several directions so that the narrow tolerances between the individual rails can be respected. Furthermore, elastic intermediate layers are used between the prefabricated concrete part and the rail, these having different thicknesses in order to be able to position the rail head at the required level. Thus many intermediate layers of different thicknesses are required in order to compensate for the relatively wide tolerances of the prefabricated concrete part. The intermediate layers and the adjustable rail fasteners are expensive to produce, install and store.

DE 197 53 705 A1 discloses concrete plates to produce a fixed track, whereby grooves are ground or cut into the concrete plates. The grooves serve to receive elastically deformable profile elements in which in turn rails can be inserted. With this method a more precise position and precise form of the grooves can already be achieved, but the tolerances and surface qualities obtainable with the milling process are nevertheless not sufficient for high-precision add-on elements such as e.g. rails. Here too the rail must be imbedded in elastically deformable profile elements which compensate for the relatively imprecise production of the receiving groove.

SUMMARY

It is therefore an object of the present invention to create a method and a device by means of which prefabricated concrete parts may be produced with narrower tolerances then those usually applied in the past for add-on parts. Thereby the expense of production, outfitting and installation of the prefabricated concrete parts as well as of the rails and their fasteners is reduced considerably. Additional objects and advantages of the invention will be set forth in part in the following description, or may be obvious from the description, or may be learned through practice of the invention.

According to the invention, the prefabricated concrete part is ground to the predetermined size by means of a grooved roller at the functionally relevant points in a method for the production of a precise prefabricated concrete part, in particular in the form of a sleeper or plate. The grooved roller has the negative form of the cross-section to be created and which the prefabricated concrete part should have at the functionally relevant point or points. This is very advantageous especially at supporting points where the rails are attached to the prefabricated concrete part. However different parts, such as e.g. installation grooves may be prepared by means of the method according to the invention for the connection of two prefabricated concrete parts following each other. By grinding the prefabricated concrete part by means of a grooved roller, it is possible to achieve especially narrow tolerances while the manufacture can nevertheless be carried out very rapidly and inexpensively.

By contrast with the milling cutters normally used in the state of the art to machine the prefabricated concrete part, a substantially smoother and more precise surface can be created by grinding the part by means of a grooved roller. On this surface the rails or additional prefabricated concrete parts can be attached with tolerances around a few tenths of a millimeter. This is very advantageous especially with high-speed vehicles to ensure a quiet and comfortable running of the rail vehicle.

The same form can be achieved in one operating cycle by means of the grooved roller on a plurality of supporting points of the prefabricated concrete part. Supporting points aligned one after the other in the longitudinal direction of the prefabricated concrete part are ground by the advance of the grooved roller without stopping along the longitudinal direction of the prefabricated concrete part. As a result, especially rapid and precise production is possible, since the grooved roller and the prefabricated concrete part are moved relatively to each other without having to determine the position of the grooved roller anew. Nevertheless, it is also possible for the grooved roller to be moved in accordance with a prepared program not only in a linear x direction but also in y and z direction of the prefabricated concrete part. Thereby the curved course of a rail on the prefabricated concrete part can also be realized.

The grooved roller is advantageously designed in such manner as to make it usable for roughing and planing. In roughing the prefabricated concrete part, a larger volume is removed in one operation. Material removed in a thickness of 1-1.5 mm per pass has proven to be advantageous. During roughing the rough contour of the functionally relevant point which is required later is already created. If needed, roughing can also be carried out in several passes, especially if a large quantity of concrete must be removed at the functionally relevant point. Following roughing the functionally relevant point is planed by means of the same grooved roller or by means of another grooved roller. Material in a thickness of approximately $\frac{1}{10}$-$\frac{2}{10}$ mm is then removed. Planing produces an especially fine surface with furthermore has narrow tolerances, so that a sleeper or plate for a fixed track is produced that is suitable for the highest speed of track-guided vehicles.

If the same grooved roller is used for roughing and for planing it is advantageous if the grooved roller is adjusted between roughing and planing. The great material removal during roughing may have damaged the form of the grooved roller. Adjusting restores the exact form of the grooved roller after roughing so that the acceptable tolerance may be respected exactly during planing.

If the prefabricated concrete part is hardened by storing it for several days after pouring and before roughing it will no longer change unreliably later and thereby the machined point will maintain the machined dimension. If other components such as rails are mounted subsequently on the fixed track these are also connected to the component in a very precise manner.

Fixed tracks especially can be designed so that the functionally relevant points are surfaces of relatively small size. For this purpose it is possible, for example, to make the fixed track with humps which are supporting points of the rails. Thereby only these supporting points require grinding. Other forms can however also be produced with the method according to the invention. Thus for example, contact points between two plates following each other that have to be connected to each other can be ground by means of the method according to the invention. Thereby the plates can be positioned very precisely in relation to each other. This also applies to connecting elements that may have to be built in and must also be inserted very precisely into the concrete part ground by the method. The remaining prefabricated concrete part can sustain tolerances such as are customary for the production of prefabricated concrete parts. In addition, an individual prefabricated concrete part can be produced through suitable grinding of the functionally relevant points. It is thus possible with fixed tracks composed of a plurality of straight-line plates in the manner of a polygon to also produce radii by grinding the appropriate supporting points.

If the blank is placed in a defined position for grinding, in particular corresponding to its subsequent assembled position, the ground functionally relevant points will also keep their tolerances relative to each other once the prefabricated concrete part is assembled at the construction site.

If the blank is positioned for its grinding without tension, e.g. by means of load cells, the component can be built in such manner at the construction site that the full tolerance of the component is available. When using individual supporting points on the component, this results in that only long-wave tolerances occur from supporting point to supporting point and are more tolerable than short-wave tolerances. Long-wave tolerances are less disturbing in high-speed travel operation than the short-wave tolerances since the latter cause wear and lack of comfort.

If the current wear of the tool is determined in the course of grinding and the tool is presented according to the determined wear, the deviations from the required target dimension due to tool wear are avoided. The required target dimension is thus maintained very precisely even in the case of several grinding points aligned one after the other.

The target dimensions of ground points are advantageously checked in order to ascertain whether the component is suitable for the intended utilization point. If it is not, the component is assigned to a different location of utilization, is reworked or is destroyed.

If the lowest supporting point of the plate to be ground is used as a basis for the grinding of the additional supporting points of the plate, the prefabricated concrete part can be given the required form with the acceptable tolerance by merely removing concrete. In this advantageous embodiment of the invention it is not necessary for the individual supporting points to be built up with additional material. Grinding the prefabricated concrete part can therefore be carried out very speedily.

To be able to give the prefabricated concrete part very rapidly the end dimension, the blank is produced in rotational production. To achieve an especially stable prefabricated concrete part, fiber concrete is used.

The blank can be ground on site at the construction site or, advantageously, also on a grinding machine, in particular a grinding machine. The precision obtained is in this case greater than with on-site grinding.

The objects are furthermore attained by a device for the production of a precision prefabricated concrete part, in particular in the form of a sleeper or plate for a fixed track for rail-guided vehicles which is a grinding machine with a grooved roller. The prefabricated concrete part is ground to a predetermined dimension at the functionally relevant points by means of the grooved roller. According to the invention, the grooved roller may be made of a wear-resistant material, in particular silicon carbide. The grinding machine on which a grooved roller made of wear-resistant material is used ensures that the profile that is ground into the prefabricated concrete part by the grooved roller is produced with extremely narrow tolerances. The grooved roller can be made in different forms in order to grind different forms. Thus it is possible, for example, to make a finished part from a blank for a different installation type for the rail. Thereby advantages are achieved in producing the prefabricated concrete part which can be used universally for different installation types. By using wear-resistant material for the grooved roller, and in spite of the great wear, a surface with very narrow tolerance is surprisingly achieved. By contrast with machining with known methods, a substantially more precise surface is obtained with the grinding of the prefabricated concrete part.

The wear-resistant material of the grooved roller is advantageously installed on a steel shaft. The grooved roller is attached by means of the steel shaft to a spindle of the grinding machine. When the wear-resistant material has been worn down to a least acceptable extent it can be applied anew by installing again wear-resistant material on the steel shaft.

If an adjusting device can be assigned to the wear-resistant material of the grooved roller, this can ensure that the required form of the grooved roller for the grinding of the component is always maintained precisely. The form transmitted to the component by means of the grooved roller is thus preserved as desired. In addition, adjusting determines a given dimension by means of which the presentation distance of the tool can be determined precisely so that the required tolerance on the component can be attained.

An adjusting device with a diamond coating has proven to be especially advantageous. The diamond coating is very resistant and thereby ensures that the adjusting device reproduces the required form of the grooved roller without unacceptable tolerances.

The grooved roller has advantageously a diameter between 700 and 400 mm. Thereby peripheral speeds are attained that make precise grinding of the prefabricated concrete part possible.

If a measuring system to measure the tool and/or the functionally relevant ground points of the prefabricated concrete part is provided for the device, the actual and target value of the tool and/or of the prefabricated concrete part can constantly checked. Unacceptable tolerances are thereby avoided.

The grooved roller is advantageously used to rough and plane the prefabricated concrete part. This makes a very rational production of the prefabricated concrete part possible. During roughing the grooved roller already produces the desired form of the functionally relevant point, however still with an unacceptable tolerance. By planing the prefabricated concrete part the tolerance is reduced to within acceptable range.

If the device is equipped with several grooved rollers, several functionally relevant points can be ground simultaneously. This is advantageous especially in grinding a plate for a fixed track or a sleeper since the supporting points of two rails running parallel to each other can thereby be ground in one operation. This also makes especially rapid and economic grinding of the prefabricated concrete part possible.

Additional advantages of the invention are described in the following examples of embodiments:

DETAILED DESCRIPTION

Figure 1:
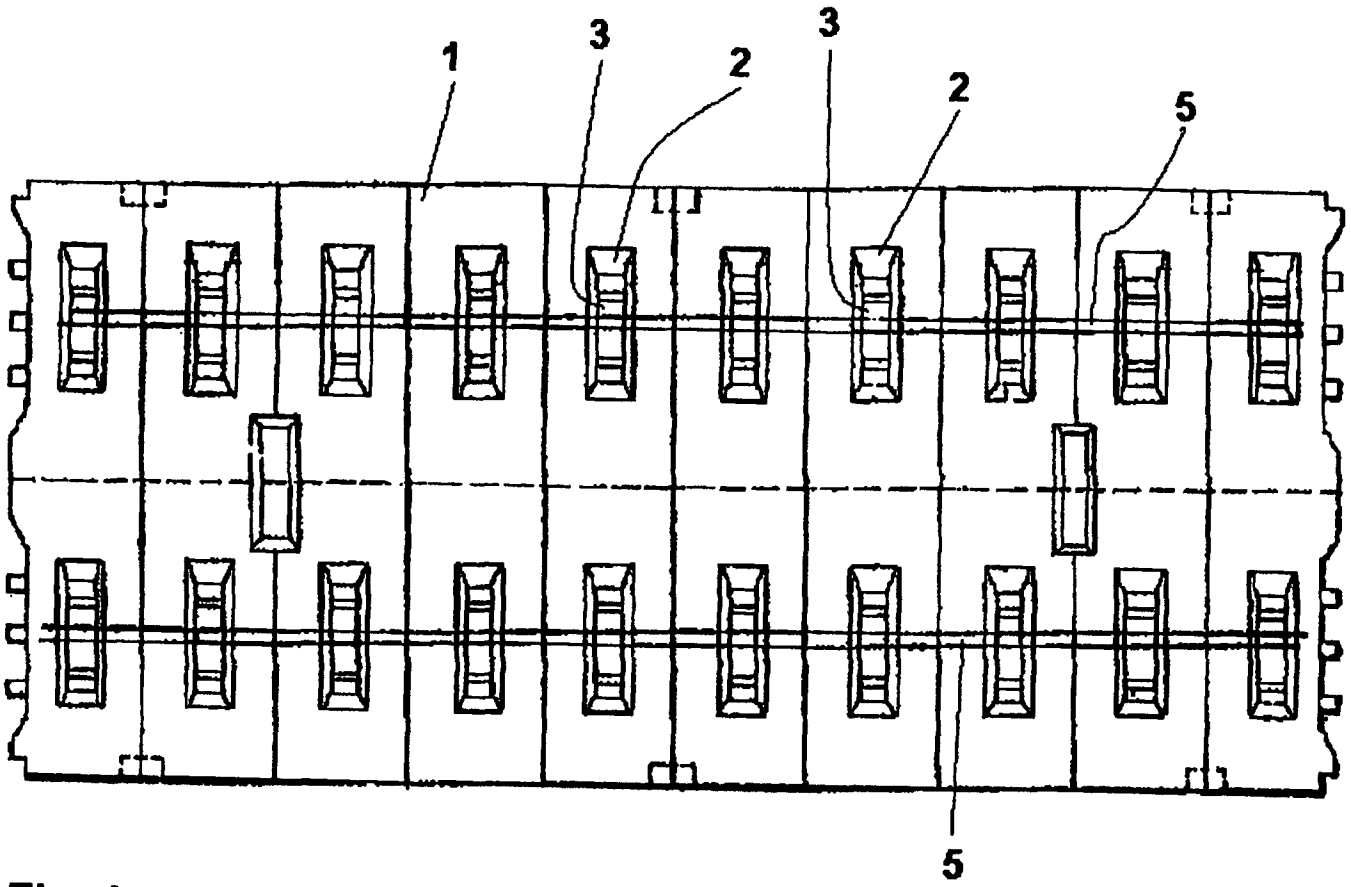
FIG. 1 shows a top view of a prefabricated concrete part.

Reference will now be made to one or more embodiments of the invention illustrated in the drawings. Each embodiment is provided by way of explanation of the invention, and not as a limitation of the invention. It is intended that the invention include modifications and variations to the embodiments illustrated or described herein.

FIG. 1 shows a drawing of a plate 1 that was produced as a prefabricated concrete part. A plurality of such plates 1 are aligned in a row and constitutes a fixed track for rail-guided vehicles. Humps 2 are provided at a distance from each other on the surface of plate 1 in two rows along the longitudinal side of the plate 1. Each hump 2 constitutes a supporting point 3 for the support of a rail. The supporting points 3 must be produced with very narrow tolerances relative to each other in order to ensure as straight a course as possible of the rails. Tolerances of only one tenth of a millimeter are for example required in this case.

Figure 2:
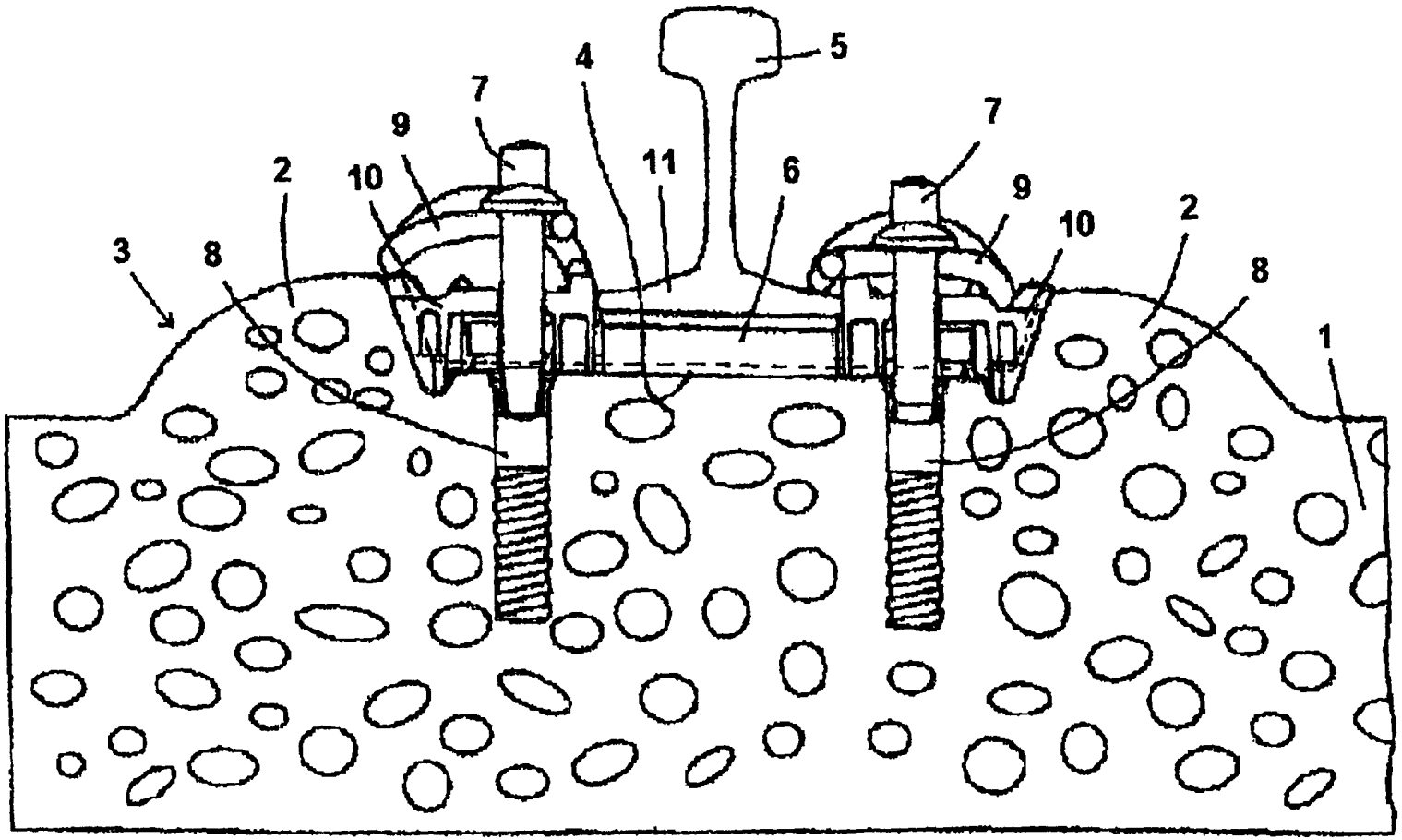
FIG. 2 shows a cross-section in the area of a supporting point of a rail and FIG. 3 shows a grinding device according to the invention.

FIG. 2 shows a detailed view of a plate 1 with a rail supporting point 3. The rail supporting point 3 is located in the hump 2 in the form of a depression. The rail supporting point 3 has here a defined from which resembles a trough. The trough bottom serves as bed 4. With intermediate layers 6 provided, a rail 5 is installed on the bed 4. The rail 5 is attached by means of screws 7 which are anchored in the concrete of plate 1 by means of plugs 8 as well as by means of clamps 9 supported on the supporting point 3 or on an angular guide plate 10 and on the rail foot 11. To ensure correct alignment of the rail 5 in the horizontal direction, the angular guide plates 10 are installed between the flanks of the rail supporting point 3 and the foot 11 of the rail 5. The rail 5 is held in the desired position in horizontal direction by means of the angular guide plates 10. The angular guide plates 10 can be standard parts substantially identical to each other. The precise production of the form of the supporting points 3 makes a replacement or any desired utilization of the angular guide plates 10 possible when laying a rail 5.

This standardized utilization of angular guide plates 10 as well as of intermediate layers 6 is created by grinding the inner sides of the rail supporting points 3 as well as, if necessary, the bed 4. This grinding of the concrete on the sides of the trough as well as of the trough bottom makes a precise alignment of the rail possible already through the production of the plate 1. The broken line indicates that the plate 1 in vicinity of the supporting points 3 is first produced too big. The precise form of the trough which is determined by the fastening means of the rail is produced by the grinding device according to the invention.

By grinding the supporting points 3 with the grinding device according to the invention it is possible to remove more or less material from the lateral parts of the trough and from the bed 4, so that the precise alignment of the rail 5 in the horizontal and vertical directions is already predetermined to a large extent by the individual forming of the rail supporting points 3. With this method, it is even possible to realize radii or a polygonal installation of the rails simply by grinding the humps 2. For this, the plates 1 are first produced in a standard manner and are individualized only by grinding. Thereby a very rapid and therefore economical production of a great number of plates 1 in one single format is possible. A distinctly more rapid production and installation of prefabricated plates 1 than by prior production and assembly methods render the application of these systems as fixed tracks even more advantageous.

The form of the supporting point 3 is produced by a grooved roller as a function of its cross-sectional trough form at a right angle to the longitudinal direction of the rail 5. The profile roller with a cross-section having the desired form as a function of the continuous line of the supporting point 3 grinds off the concrete at the required points and prepares the supporting point 3 for the corresponding fastening device for the rail 5 provided for it.

Figure 3:
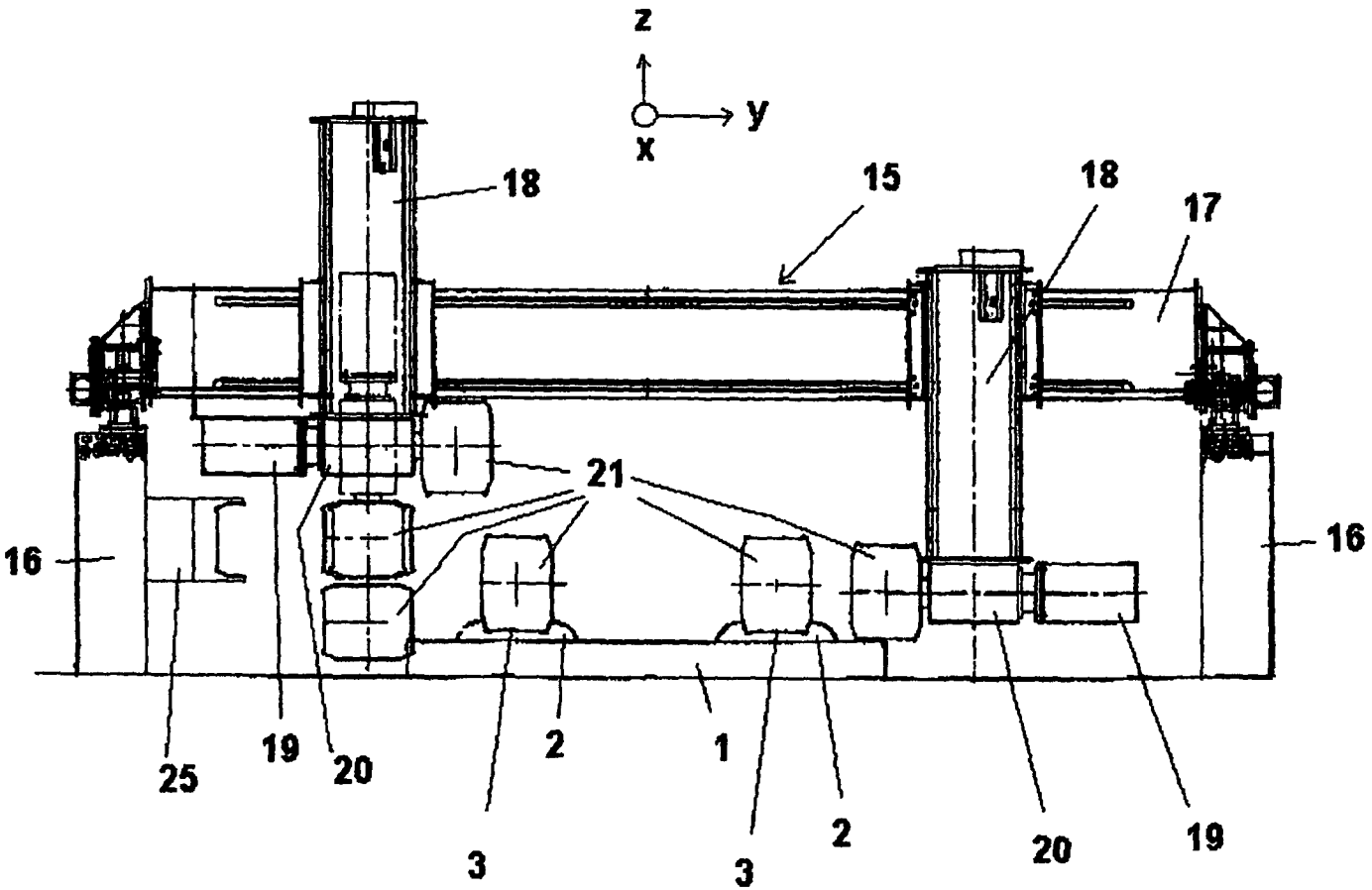

FIG. 3 shows a sketch of a grinding device according to the invention. The grinding device is made in form of a portal grinding device. A tie-bar 17 is supported on two bearings 16 so that it can be displaced in direction x. Two shifting carriages 18 are assigned to the tie-bar 17 for the individual positioning of the grinding device 15. The shifting carriages 18 make it possible to position the grinding device precisely in directions y and z.

A drive 19 and a swiveling device 20 connected to a grooved roller 21 are provided on the shifting carriage 18. The grooved roller 21 is driven via the drive 19. The grooved roller 21 is presented to the plate 1 by means of the portal grinding machine. The form of the supporting point 3 on the hump 2 is created by the special form of the grooved roller 21. By shifting the tie-bar 17 in direction x the grooved roller 21 is moved over a plurality of individual supporting points 3 on plate 1 and the mounting surface for the rail 5 is thus created. By appropriate control of the shifting carriage 18 in directions y and z individual positioning of the supporting points 3 on the humps 2 is possible so that even curved or polygonal installation of the rail is possible.

In the drawing of FIG. 3 different positions of the grooved roller 21 are shown that can be achieved thanks to the possibility of displacing the tie-bar or the shifting carriage 18 and to the swiveling device 20.

To produce the exact forms of the supporting points 3 the grinding device is moved by means of its tie-bar 17 one or several times essentially in direction x over the plate 1. In this process the grooved roller is presented to achieve nearly the desired target dimension of the supporting point 3. The different presentation steps may be relatively wide. This roughing of the supporting point 3 can thereby carried out very rapidly. Only for the last displacement of the tie-bar 17 in direction x over the plate 1 is the presentation adjusted more narrowly. As a result the supporting point 3 is given a very precise form. In order to have a grooved roller 21 available for this last operation which produces the desired form as precisely as possible, the grooved roller 21 is presented to an adjusting device 25. The adjusting device 25 consists of an adjusting plate coated with diamonds which reproduces the precise form of the supporting point 3 in its cross-section. By setting the rotating grooved roller 21 on the adjusting device 25, the grooved roller which is made of softer material than the adjusting device 25 is adapted to the form of the adjusting device. In the final planing, i.e. grinding of a layer that is only a few tenths of a millimeter thick on the supporting point 3 this cross-sectional form of the grooved roller is thereby reproduced on the supporting point 3. Very precise forming is thus obtained.

While it was always assumed in the state of the art for the grinding of prefabricated concrete parts that a very hard and highly wear-proof tool must be used in order to make precise forming of the prefabricated concrete part possible, the present invention assumes that the actual tool is subjected to relatively great wear. The last grinding is however carried out only when the tool has once more been given the desired form and has possibly also been measured once more. Surprisingly it has been shown that a considerably faster and more economic production of prefabricated concrete parts with extremely precise forming at least at several points of the prefabricated concrete part is possible with this device according to the invention and with the corresponding production method. This is especially necessary for plates and fixed tracks, since a very great number of plates are needed to produce fixed tracks and since these plates are laid down very rapidly. The time bottleneck that has been occurring in the past in the production of fixed tracks can thus be improved significantly.

The present invention is not limited to the embodiments shown. Other prefabricated concrete parts requiring extremely precisely dimensioned points can also be produced by means of the method according to the invention, in particular if these points have a longitudinal extension with the same cross-section that can be ground. Furthermore it is alternatively possible to move the prefabricated concrete part towards the grinding device and not, as in the embodiment shown, the grinding device relatively to a stationary plate. The creation of connection location of the individual plates in a row is possible with the method according to the invention as represented. Hereby the faces of the plates abutting against each other for example are ground. Suitable connecting elements can thereby connect the plates to each other in a precisely positioned manner. This is also an advantage if the plates are not laid down in a straight line but polygonally relative to each other. The faces of the plates 1 can be ground accordingly also in this case.

The invention claimed is:

1. A method for producing a precise prefabricated concrete part in the form of a plate for a fixed track for rail guided vehicles, comprising using a grooved roller to grind connection surfaces for add on elements of the fixed track into the prefabricated concrete part at relevant points along the concrete part, the grooved roller defining the connection surfaces to desired predetermined dimensions, and further comprising:

determining relative wear of the grooved roller during the grinding process by setting the grooved roller on an adjusting device made of harder material than the grooved roller and thereby adapting the firm of the grooved roller to the adjusting device and presenting the grooved roller to the prefabricated concrete part.

2. A device for production of a precise prefabricated concrete part in the form of a plate for a fixed track of a rail guided vehicle system, said device comprising a grinding machine with a grooved roller configured thereon to grind functionally relevant connection surfaces into the prefabricated concrete part for connection of add on elements, said grooved roller having dimensions corresponding to desired dimensions of the connection surfaces and being formed of a material that wears relative to the prefabricated concrete part, and further comprising an adjusting device having a material selected to grind down said wear material of said grooved roller upon presentation of said grooved roller against said adjusting device to precisely define the dimensions of said grooved roller.

* * * * *